United States Patent [19]

Kopko et al.

[11] Patent Number: 4,499,851

[45] Date of Patent: Feb. 19, 1985

[54] SELF-SPACED DEVELOPMENT SYSTEM

[75] Inventors: John J. Kopko, Macedon; Dan A. Hays, Fairport, both of N.Y.

[73] Assignee: Xerox Corporation, Stamford, Conn.

[21] Appl. No.: 555,258

[22] Filed: Nov. 25, 1983

Related U.S. Application Data

[63] Continuation of Ser. No. 111,450, Jan. 11, 1980, abandoned.

[51] Int. Cl.[3] ..... G03G 15/09

[52] U.S. Cl. ..... 118/658; 118/602

[58] Field of Search ..... 427/658, 602

[56] References Cited

U.S. PATENT DOCUMENTS 4,264,182 4/1981 Mitchell ..... 118/657

*Primary Examiner*—Bernard D. Pianalto

*Attorney, Agent, or Firm*—H. Fleischer; J. E. Beck; R. Zibelli

[57] ABSTRACT

An apparatus which develops a latent image recorded on a flexible member. Developer material is transported into contact with the flexible member in the development zone so as to develop the latent image. The flexible member is maintained at a pre-selected tension. As the developer material contacts the flexible member in the development zone, the flexible member deforms so as to conform, at least partially, to the developer material.

16 Claims, 4 Drawing Figures

SELF-SPACED DEVELOPMENT SYSTEM

This is a continuation of application Ser. No. 111,450, filed Jan. 11, 1980, abandoned.

This invention relates generally to electrophotographic printing, and more particularly concerns an apparatus for developing a latent image.

Generally, an electrophotographic printing machine includes a photoconductive member which is charged to a substantially uniform potential to sensitize its surface. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer material into contact therewith. This forms a powder image on the photoconductive member which is subsequently transferred to a copy sheet. Finally, the copy sheet is heated to permanently affix the powder image thereto in image configuration.

Frequently, the developer material is made from a mixture of carrier granules and toner particles. The toner particles adhere triboelectrically to the carrier granules. This two component mixture is brought into contact with the latent image. Toner particles are attracted from the carrier granules to the latent image forming the powder image thereof. Hereinbefore, it has been difficult to develop both the large solid areas of the latent image and the fine lines thereof. Different techniques have been utilized to improve development of the latent image. For example, cascade systems, fur brush systems, magnetic brush systems and combinations of these systems have heretofore been used in electrophotographic printing machines. However, in all of the foregoing types of systems there continued to exist the problem of achieving uniform development for both the fine lines and large solid areas of the electrostatic latent image. It has been extremely difficult to completely develop both the fine image areas as well as the larger solid areas while maintaining a minimum background density. Development can be improved by reducing the spacing between the photoconductor and the development system. However, in the case of rigid photoconductors this is limited by the expense of reducing the tolerance accumulation between the rigid photoreceptor and development system.

With the increased usage of flexible photoconductor belts and magnetic brush developer rollers, it became more feasible to reduce the spacing therebetween. When the photoconductor belt is maintained at the proper tension, it now became practical to permit the developer material to maintain the spacing between the belt and developer roller. The flexible nature of the belt permitted greater developer roll runout at narrow spacings. This narrow spacing increased the development fields improving development. A smaller quantity of developer material is now used in the development zone extending developer material life.

Various approaches have been devised to improve development. The following disclosures appear to be relevant: U.S. Pat. No. 4,013,041. Patentee: Armstrong et al. Issued: Mar. 22, 1977. Research Disclosure Journal; July, 1979, Page 352, No. 18318. Disclosed by: Swapceinski.

The pertinent portions of the foregoing disclosures may be briefly summarized as follows:

Armstrong et al. discloses an electrophotographic printing machine having a magnetic brush developer roller contacting one side of a flexible photoconductive belt. As shown in FIG. 3, guide rollers maintain a portion of the belt in a slackened condition so that the belt is capable of moving freely toward and away from the developer roller in response to the varying contours thereof.

Swapceinski describes an elctrophotographic printing machine including a gimballed back-up roller engaging the backside of a photoconductive belt. The guide roller is opposed from the developer roller to compensate for relative changes in the thickness of the developer material on the developer roller, as well as maintaining constant pressure in the nip between the developer roller and photoconductive belt.

In accordance with the present invention, there is provided an apparatus for developing a latent image recorded on a flexible member. Means, positioned closely adjacent to the flexible member defining a development zone therebetween, transport a developer material into contact with the flexible member in the development zone so as to develop the latent image. Means are provided for maintaining the flexible member at a pre-selected tension of sufficient magnitude so that the developer material being transported into contact therewith deforms the flexible member in the development zone. In this way, the flexible member conforms, at least partially, to the developer material being transported into contact therewith.

Other aspects of the present invention will become apparent as the following description proceeds and upon reference to the drawings, in which:

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
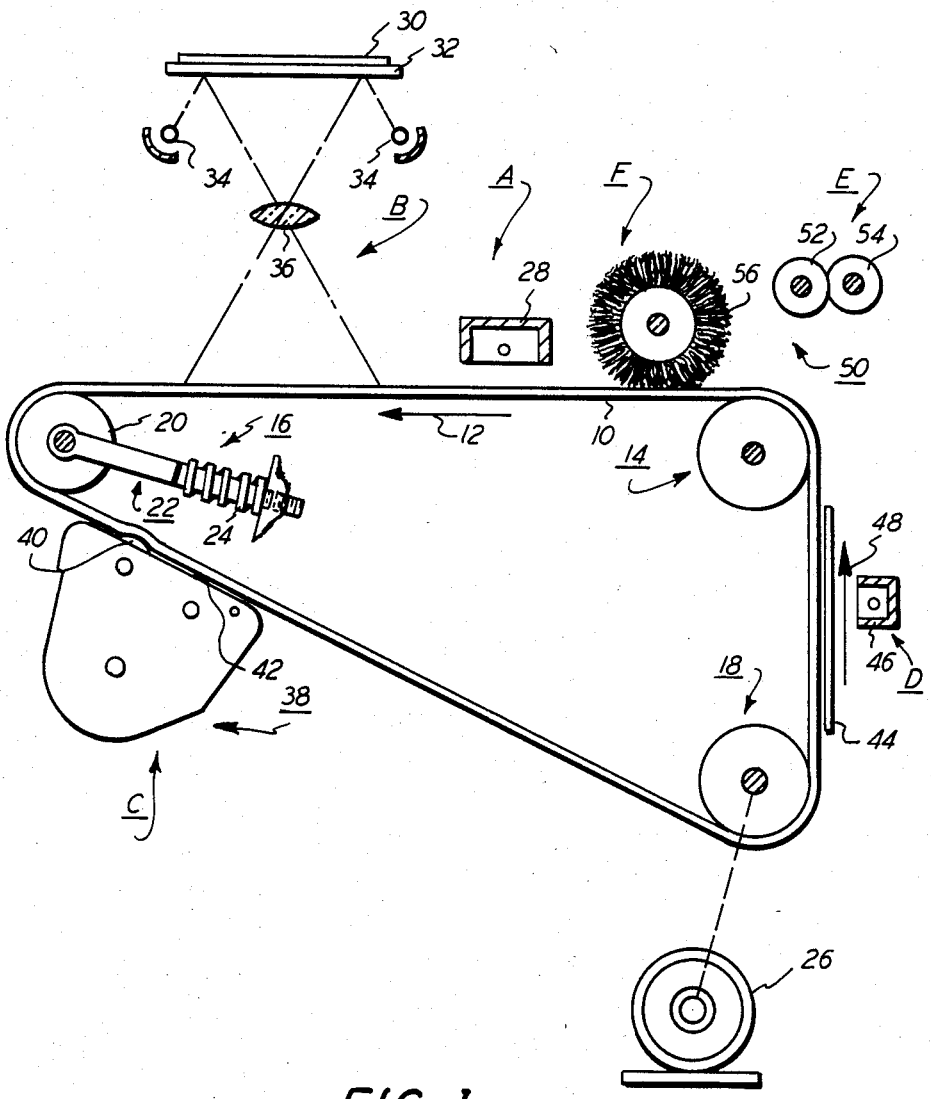
FIG. 1 is a schematic elevational view depicting an electrophotographic printing machine incorporating the features of the present invention therein.

For a general understanding of the illustrative printing machine incorporating the features of the present invention therein, reference is made to the drawings. In the drawings, like reference numerals have been used throughout to designate identical elements. FIG. 1 schematically depicts the various components of an electrophotographic printing machine employing the development system of the present invention therein. Although this development system is particularly well adapted for use in the illustrative electrophotographic printing machine, it will become evident from the following discussion that it is equally well suited for use in a wide variety of electrostatographic printing machines and is not necessarily limited in its application to the particular embodiment shown herein.

DETAILED DESCRIPTION OF THE DRAWINGS

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface deposited on a conductive substrate. Preferably, the photoconductive surface comprises a transport layer containing small molecules of m-TDB dispersed in a polycarbonate and a generation layer of trigonal selenium. The conductive substrate is made preferably from aluminized Mylar which is electrically grounded. Belt 10 moves in the direction of arrow 12 to advance successive portions of the photoconductive surface sequentially through the various processing stations disposed about the path of movement thereof. The path of movement of belt 10 is defined by stripping roller 14, tensioning system 16, and drive roller 18. As shown in FIG. 1, tension system 16 includes a roller 20 over which belt 10 moves. Roller 20 is mounted rotatably in yoke 22. Spring 24, which is initially compressed, resiliently urges yoke 22 in a direction such that roller 20 presses against belt 10. In this way, belt 10 is placed under the desired tension. The level of tension is relatively low permitting belt 10 to be relatively easily deformed. The detailed structure of the tensioning system will be described hereinafter with reference to FIG. 2. With continued reference to FIG. 1, drive roller 18 is mounted rotatably and in engagement with belt 10. Motor 26 rotates roller 18 to advance belt 10 in the direction of arrow 12. Roller 18 is coupled to motor 26 by suitable means such as a belt drive. Stripping roller 14 is freely rotatable so as to readily permit belt 10 to move in the direction of arrow 12 with a minimum of friction.

Initially, a portion of belt 10 passes through charging station A. At charging station A, a corona generating device, indicated generally by the reference numeral 28, charges the photoconductive surface of belt 10 to a relatively high, substantially uniform potential.

Next, the charged portion of the photoconductive surface is advanced through exposure station B. At exposure station B, an original document 30 is positioned facedown upon transparent platen 32. Lamps 34 flash light rays onto original document 30. The light rays reflected from original document 30 are transmitted through lens 36 forming a light image thereof. Lens 36 focuses the light image onto the charged portion of the photoconductive surface to selectively dissipate the charge thereon. This records an electrostatic latent image on the photoconductive surface which corresponds to the informational areas contained within original document 30.

Thereafter, belt 10 advances the electrostatic latent image recorded on the photoconductive surface to development station C. At development station C, a magnetic brush development system, indicated generally by the reference numeral 38, advances a conductive developer material into contact with the electrostatic latent image. Preferably, magnetic brush development system 38 includes a developer roller 40 and a transport roller 42. Developer roller 40 transports a brush of developer material comprising magnetic carrier granules and toner particles into contact with belt 10. As shown in FIG. 1, developer roller 40 is positioned such that the brush of developer material deforms belt 10 in an arc such that belt 10 conforms at least partially, to the configuration of the developer material. The electrostatic latent image attracts the toner particles from the carrier granules forming a toner powder image on the photoconductive surface of belt 10. Transport roller 42 returns the un-used developer material to the sump of development system 38 for subsequent re-use. The detailed structure of magnetic brush development system 38 will be described hereinafter with reference to FIGS. 3 and 4.

Belt 10 then advances the toner powder image to transfer station D. At transfer station D, a sheet of support material 44 is moved into contact with the toner powder image. The sheet of support material 44 is advanced to transfer station D by a sheet feeding apparatus (not shown). Preferably, the sheet feeding apparatus includes a feed roll contacting the uppermost sheet of a stack of sheets. The feed roll rotates so as to advance the uppermost sheet from the stack into a chute. The chute directs the advancing sheet of support material into contact with the photoconductive surface of belt 10 in a timed sequence so that the toner powder image developed thereon contacts the advancing sheet of support material at transfer station D.

Transfer station D includes a corona generating device 46 which sprays ions onto the backside of sheet 44. This attracts the toner powder image from the photoconductive surface to sheet 44. After transfer, sheet 44 moves in the direction of arrow 48 onto a conveyor (not shown) which advances sheet 44 to fusing station E.

Fusing station E includes a fuser assembly, indicated generally by the reference numeral 50, which permanently affixes the transferred toner powder image to sheet 44. Preferably, fuser assembly 50 includes a heated fuser roller 52 and a back-up roller 54. Sheet 44 passes between fuser roller 52 and back-up roller 54 with the toner powder image contacting fuser roller 52. In this manner, the toner powder image is permanently affixed to sheet 44. After fusing, a chute guides the advancing sheet 44 to a catch tray for subsequent removal from the printing machine by the operator.

Invariably, after the sheet of support material is separated from the photoconductive surface of belt 10, some residual particles remain adhering thereto. These residual particles are removed from the photoconductive surface at cleaning station F. Cleaning station F includes a rotatably mounted fiberous brush 56 in contact with the photoconductive surface. The particles are cleaned from the photoconductive surface by the rotation of brush 56 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
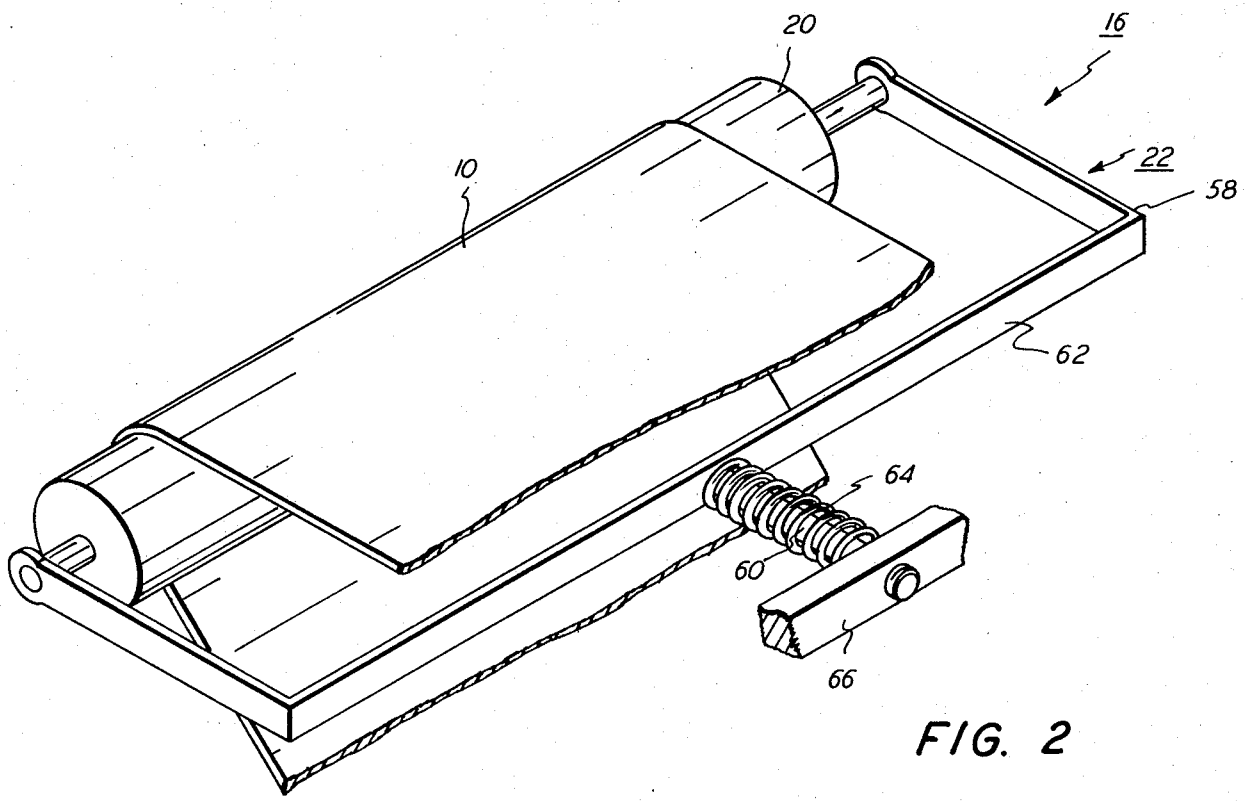
FIG. 2 is a fragmentary, perspective view showing the belt tensioning arrangement for the FIG. 1 printing machine.

Referring now to the specific subject matter of the present invention, FIG. 2 depicts tensioning system 16 in greater detail. As shown thereat, tensioning system 16 includes roller 20 having belt 10 passing thereover. Roller 20 is mounted in suitable bearings in a yoke, indicated generally by the reference numeral 22. Preferably, yoke 22 includes a U-shaped member 58 supporting roller 20 and a rod 60 secured to the midpoint of cross member 62 of U-shaped member 58. A coil spring 64 is wrapped around rod 60. Rod 60 is mounted slidably in the printing machine frame 66. Spring 64 is compressed between cross member 62 and frame 66. Compressed spring 64 resiliently urges yoke 22 and, in turn, roller 20 against belt 10. Spring 64 is designed to have the appropriate spring constant such that when placed under the desired compression, belt 10 is tensioned to about 0.1 kilograms per linear centimeter. Belt 10 is maintained under a sufficiently low tension to enable the developer material on developer roller 40 to deform belt 10 through an arc ranging from about 10° to about 40°.

Figure 3:
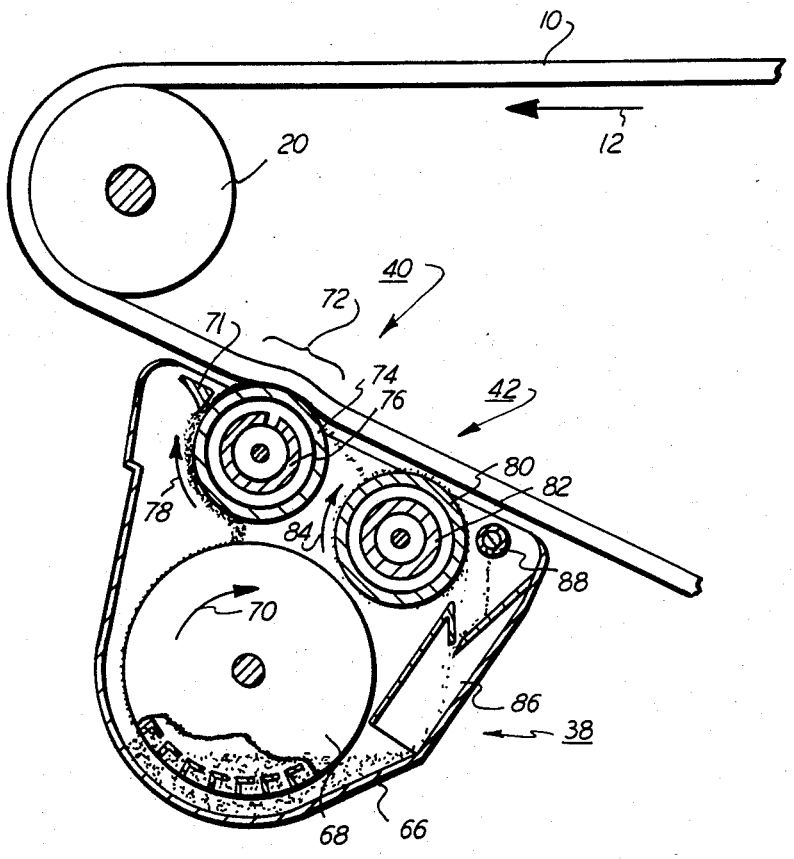
FIG. 3 is an elevational view illustrating the development system used in the FIG. 1 printing machine.

Referring now to FIG. 3, the detailed structure of development system 38 will be described. Development system 38 includes a housing 66 defining a chamber for storing a supply of developer material therein. A cylindrical member 68, mounted rotatably in the chamber of housing 66 includes a plurality of vanes extending outwardly therefrom so as to act as a paddle wheel when rotating in the direction of arrow 70. In this way, cylindrical member 68 advances the developer material in an upwardly direction to developer roller 40. A metering blade 71 is positioned closely adjacent to developer roller 40 defining a gap therebetween through which the developer material passes. This gap regulates the quantity of developer material being advanced into development zone 72 by developer roller 40. Preferably, one end portion of metering blade 71 extends in a longitudinal direction substantially across the width of developer roller 40 so as to provide a uniform gap controlling the quantity of material being moved into development zone 72. The other end portion of metering blade 71 is secured to housing 66. Developer roller 40 includes a non-magnetic tubular member 74 journaled for rotation. By way of example, tubular member 74 is made from aluminum having the exterior circumferential surface thereof roughened. An elongated magnet 76 is positioned concentrically within tubular member 74 being spaced from the interior circumferential surface thereof. Magnetic 74 has a plurality of magnetic poles impressed thereon. Preferably, magnet 74 comprises a keeper having a layer of magnetic rubber secured thereto. The layer of magnetic rubber is omitted in the region of development zone 72. Thus, no magnetic poles are positioned in development zone 72, i.e. in the nip opposed from belt 10. In this way, the magnetic poles generate a strong magnetic field in the development zone entrance and a weak magnetic field in development zone itself. The radial magnetic field in the development zone is preferably about 100 gauss.

Tubular member 74 is electrically biased by a voltage source (not shown) to a suitable polarity and magnitude, preferably to a level intermediate that of the background voltage level and the image voltage level recorded on the photoconductive surface of belt 10. By way of example, the voltage source preferably electrically biases tubular member 74 to a voltage ranging from about 50 volts to about 350 volts. A motor 90 (FIG. 4) rotates tubular member 74 at a constant angular velocity. A brush of developer material is formed on the peripheral surface of tubular member 74. As tubular member 74 rotates in the direction of arrow 78, the brush of developer material advances into contact with belt 10 in development zone 72. The compressed pile height of the developer material in development zone 70 ranges from about 0.04 centimeters to about 0.15 centimeters. As previously indicated, the brush of developer material in development zone 72 deforms belt 10. Preferably, belt 10 is deformed in development zone 72 so as to form an arc about tubular member 74. The deformation arc ranges from about 10° to about 40°. Magnetic 76 is preferably mounted stationarily being arranged to attract the developer material thereto due to the magnetic properties of the carrier granules which have the toner particles adhering triboelectrically thereto. These toner particles are attracted from the carrier granules to the latent image in the development zone so as to form a toner powder image on the photoconductive surface of belt 10.

After the electrostatic latent image has been developed, the un-used developer material and de-nuded carrier granules are received by transport roller 42. Transport roller 42 includes a non-magnetic tubular member 80 journaled for rotation. Preferably, tubular member 80 is made from aluminum having the exterior circumferential surface thereof roughened. As shown in FIG. 3, tubular member 80 is spaced from belt 10. An elongated magnetic 82 is disposed interiorly of tubular member 80 and spaced therefrom. Preferably, magnet 82 comprises a keeper having a layer of magnetic rubber secured thereto. Magnetic poles are impressed about the magnet with the exit region being devoid of magnetic poles. In this way, the developer material and de-nuded carrier granules are advanced as tubular member 80 rotates in the direction of arrow 84 to the exit region. In this region, the magnetic attractive force is less than the gravational force and the un-used developer material and de-nuded carrier granules fall into cross mixer 86. Cross-mixer 86 includes a plurality of spaced, transversely extending baffles arranged to cause the unused developer material and de-nuded carrier granules to mix with new toner particles being furnished to the development system. Toner dispenser 88 is positioned above cross-mixer 86 so as to furnish a supply of new toner particles to the development system. In this way, the concentration of toner particles within the development material is maintained substantially constant. Preferably, toner dispenser 88 includes a helical auger positioned in a flexible, elongated tube having a plurality of apertures therein. The tube extends across housing 66 above cross-mixer 86. This tube is also connected to a remotely located supply of toner particles. The helical auger advances the toner particles along the tube to be dispensed through the apertures therein into cross-mixer 86. In cross-mixer 86, the new toner particles mix with the denuded carrier granules and un-used developer material. Thus, a new supply of developer material is continually returned to the sump of housing 66 in the region of cylindrical member 68 for subsequent re-use in developing the electrostatic latent image recorded on belt 10.

Preferably, the developer material includes carrier granules having a ferromagnetic core with a thin layer of magnetite overcoated with a non-continuous layer of resinous material. Suitable resins include poly(vinylidene fluoride) and poly(vinylidene fluorideco-tetrafluoroethylene). The developer materials can be prepared mixing the carrier granules with the toner particles. Generally, any of the toner particles known in the art are suitable for mixing with the carrier granules. Suitable toner particles are prepared by finely grinding a resinous material and mixing it with a coloring material. By way of example, the resinous material may be a vinyl polymer such as polyvinyl chloride, polyvinylidene chloride, polyvinyl acetate, polyvinylacetals, polyvinyl ether, and poly acrilic. Suitable coloring materials may be amongst others chromogen black and solvent black. The developer material comprises about 95% to about 99% by weight of carrier granules and from about 5% to about 1% by weight of toner particles. These and other materials are disclosed in U.S. Pat. No. 4,076,857 issued to Kasper et al. in 1978, the relevant portions thereof being hereby incorporated into the present application.

Figure 4:
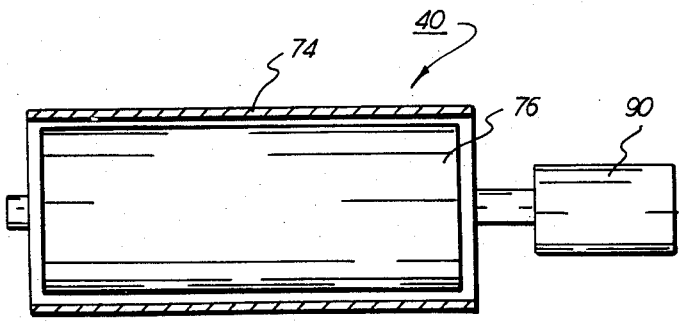
FIG. 4 is an elevational view depicting the developer roller of the FIG. 2 development system.

Turning now to FIG. 4, there is shown a drive system for developer roller 40. As illustrated thereat, magnet 76 is positioned concentrically and stationarily within tubular member 74. Tubular member 74 is coupled to motor 90. Preferably, motor 90 rotates tubular member 74 at a substantially constant angular velocity. Magnet 76 has the exterior circumferential surface thereof spaced from the interior circumferential surface of tubular member 74. In this way, the magnetic field generated by magnet 76 attracts the developer material to the exterior circumferential surface of tubular member 74. As motor 90 rotates tubular member 74 in the direction of arrow 78 (FIG. 3), the developer material is advanced into development zone 72. The advancing developer material contacts belt 10, and deforms belt 10 in an arc. In this way, the spacing between belt 10 and tubular member 74 is controlled by the compressed pile height of the developer material in development zone 72. Moreover, the effects of run-out are eliminated inasmuch as there is continually an interference between the developer material and belt 10 irrespective of the non-concentricity of tubular member 74. This system enables developer roller 40 to be closely spaced to the photoconductive belt with the magnetic fields in the development zone being relatively low so as to produce high developability and low background. Moreover, the quantity of developer material required in development zone is significantly reduced.

In recapitulation, it is clear that the development apparatus of the present invention has a developer roller positioned closely adjacent to the photoconductive surface of a belt so as to transport developer material into contact with the latent image in the development zone. The belt is maintained at a pre-selected tension of sufficient magnitude to enable the developer material being transported into contact therewith by the developer roller to deform the belt in the development zone. In this way, the belt conforms, at least partially, to the developer material being transported into contact therewith so as to significantly improve development of the latent image.

It is, therefore, evident that there has been provided in accordance with the present invention an apparatus for developing an electrostatic latent image that improves development while reducing the required amount of developer material used therefor. This apparatus fully satisfies the aims and advantages hereinbefore set forth. While this invention has been described in conjunction with a specific embodiment thereof, it is evident that many alternatives, modifications, and variations will apparent to those skilled in the art. Accordingly, it is intended to embrace all such alternatives, modifications, and variations as fall within the spirit and broad scope of the appended claims.

What is claimed is:

1. An apparatus for developing a latent image recorded on a flexible member, including:

a tubular member journaled for rotary movement;

means for rotating said tubular member to transport developer material into contact with the latent image in a development zone;

a magnetic member disposed interiorly of and spaced from said tubular member for attracting the developer material to said tubular member, said magnetic member being oriented so that the magnetic poles thereon generate a strong magnetic field in the development zone entrance and a weak magnetic field in the development zone; and means for maintaining the flexible member, in at least the region of the development zone, at a pre-selected tension of sufficient magnitude so that the developer material being transported into contact with the flexible member by said tubular member is compressed between said tubular member and the flexible member in the development zone with the flexible member wrapping about at least a portion of said tubular member forming an extended development zone.

2. An apparatus as recited in claim 1, wherein the flexible member is a belt.

3. An apparatus as recited in claim 2, wherein the developer material, in the development zone, deforms the belt in an arc ranging from about 10° to about 40°.

4. An apparatus as recited in claim 3, wherein said maintaining means tensions said belt to a magnitude of about 0.1 kilogram per linear centimeter.

5. An apparatus as recited in claim 4, wherein the magnetic field in the development zone is about 100 gauss.

6. An apparatus as recited in claim 5, further including means for regulating the quantity of developer material being transported into the development zone by said tubular member.

7. An apparatus as recited in claim 6, further including:

means for storing a supply of developer material; and means for advancing the developer material from said storing means to said tubular member.

8. An apparatus as recited in claim 7, for developer materials having toner particles adhering triboelectrically to the magnetic granules, further including:

means for mixing the toner particles with the magnetic granules and returning the mixture to said storing means for subsequent re-use; and means for moving un-used developer material from said tubular member to said mixing means.

9. An electrophotographic printing machine of the type having an electrostatic latent image recorded on a flexible photoconductive member, wherein the improvement includes:

a tubular member journaled for rotary movement;

means for rotating said tubular member to transport developer material into contact with the electrostatic latent image in a development zone;

a magnetic member disposed interiorly of and spaced from said tubular member, said magnetic member being oriented so that the magnetic poles thereon generate a strong magnetic field in the development zone entrance and a weak magnetic field in the development zone; and means for maintaining the flexible member, in at least the development zone, at a pre-selected tension of sufficient magnitude so that the developer material being transported into contact with the photoconductive member by said tubular member is compressed between said tubular member and the photoconductive member in the development zone with the flexible member wrapping about at least a portion of said tubular member forming an extended development zone.

10. A printing machine as recited in claim 9, wherein the flexible photoconductive member is a belt.

11. A printing machine as recited in claim 10, wherein the developer material, in the development zone, deforms the belt in an arc extending from about 10° to about 40°.

12. A printing machine as recited in claim 10, wherein said maintaining means tensions said belt to a magnitude of about 0.1 kilogram per linear centimeter.

13. A printing machine as recited in claim 12, wherein the magnetic field in the development zone is about 100 gauss.

14. A printing machine as recited in claim 12, further including means for regulating the quantity of developer material being transported into the development zone by said tubular member.

15. A printing machine as recited in claim 14, further including:

means for storing a supply of developer material; and means for advancing the developer material from said storing means to said tubular member.

16. A printing machine as recited in claim 15, for developer materials having toner particles adhering triboelectrically to the magnetic granules, further including:

means for mixing the toner particles with the magnetic granules and returning the mixture to said storing means for subsequent re-use; and means for moving un-used developer material from said tubular member to said mixing means.

* * * * *